United States Patent [19]

Monroe

[11] 4,389,744

[45] Jun. 28, 1983

[54] SYSTEM AND METHOD FOR SECURING BED COVERINGS TO THE MATTRESS OF A BED

[76] Inventor: Gerald E. Monroe, 1516 NE. 96th St., Seattle, Wash. 98115

[21] Appl. No.: 206,353

[22] Filed: Nov. 13, 1980

[51] Int. Cl.[3] ..... A47G 9/02

[52] U.S. Cl. ..... 5/498; 5/496

[58] Field of Search ..... 5/498, 497, 496, 495, 5/482

[56] References Cited

U.S. PATENT DOCUMENTS

| | | | |
|---|---|---|---|
| 2,239,017 | 4/1941 | Roberts | 5/498 |
| 3,144,666 | 8/1964 | Mazera et al. | 5/497 |
| 3,606,622 | 9/1971 | Williams et al. | 5/498 |
| 3,906,559 | 9/1975 | Bahr | 5/496 |
| 4,035,854 | 7/1977 | Pardee | 5/497 |
| 4,045,831 | 9/1977 | Clark | 5/497 |

*Primary Examiner*—Alexander Grosz

*Attorney, Agent, or Firm*—Seed, Berry, Vernon & Baynham

[57] ABSTRACT

A method and system are disclosed for attaching bed coverings to the mattress of a bed to prevent them from being pulled loose and to make the task of making the bed on a day-by-day basis easier and quicker. The spread for the bed includes a flap secured near the foot end of the spread extending essentially the width of the mattress, the flap including an elastic strap secured at or near its terminal edge adapted to fit around and across the mattress. Any blankets and the top sheet to be secured to the bed are each fitted with an elastic strap along their respective edges for securing under the foot end of the mattress, the elastic strap extending along the terminal edge essentially the width of the mattress and adapted to fit around and across the top surface of the mattress. The coverings are secured to the mattress in reverse order; i.e., the flap of the spread is first positioned beneath the mattress with the elastic strap extending across the top surface of the mattress. The end of the blanket, if one is used, bearing the elastic strap, is then positioned between the underside of the mattress and the flap of the spread, with the elastic strap of the blanket extending over and across the top surface of the mattress. The top sheet is similarly secured. The bottom sheet and mattress pad, if one is used, are conventionally secured to the mattress.

6 Claims, 4 Drawing Figures

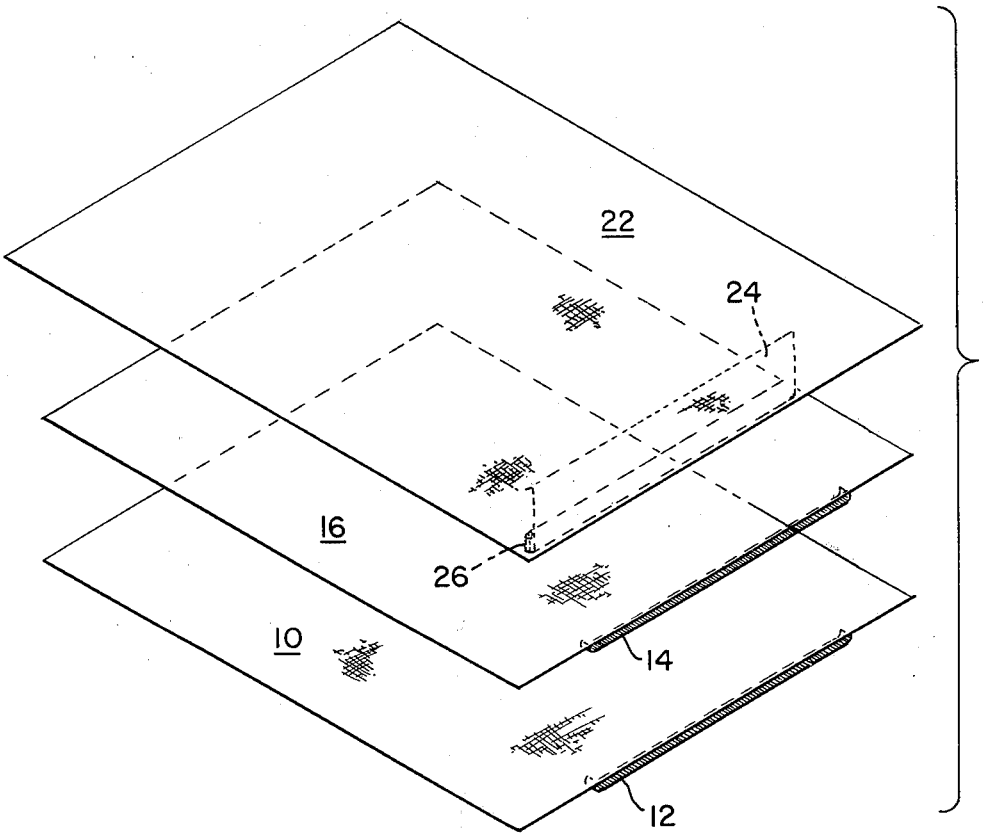
FIG. 1
FIG. 2
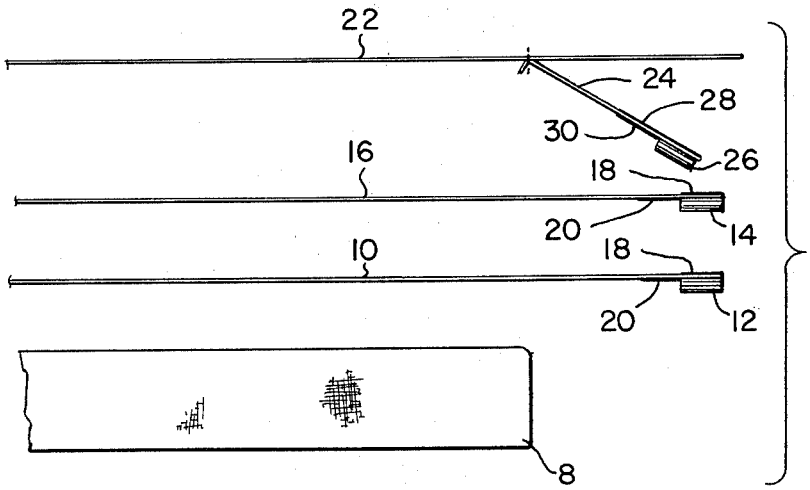

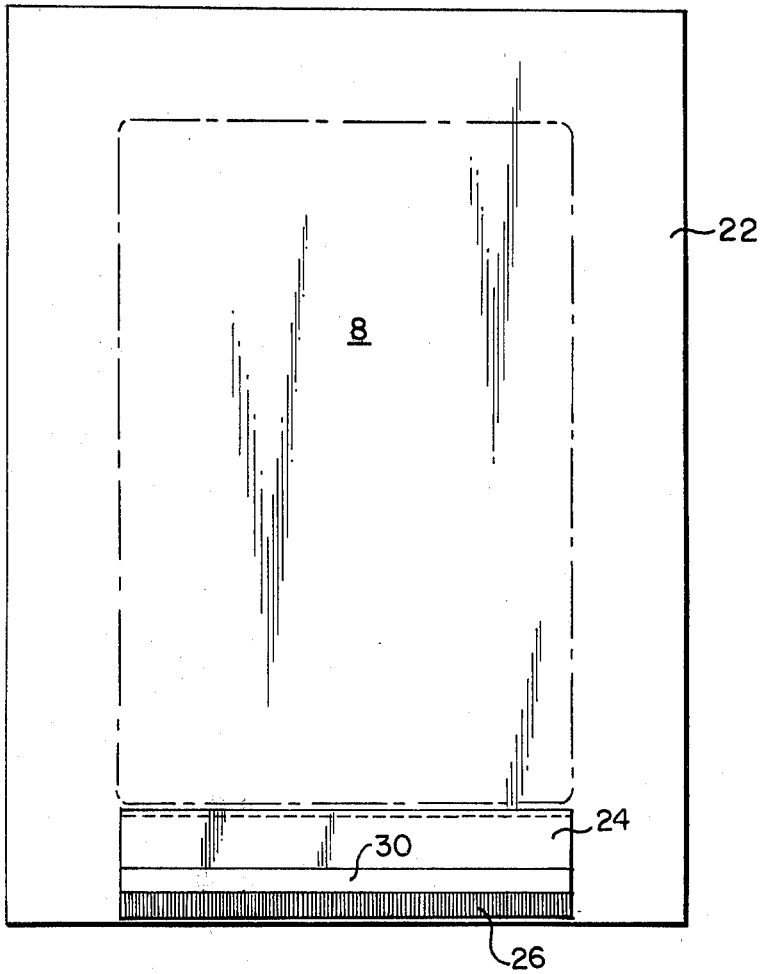
FIG. 3
FIG. 4
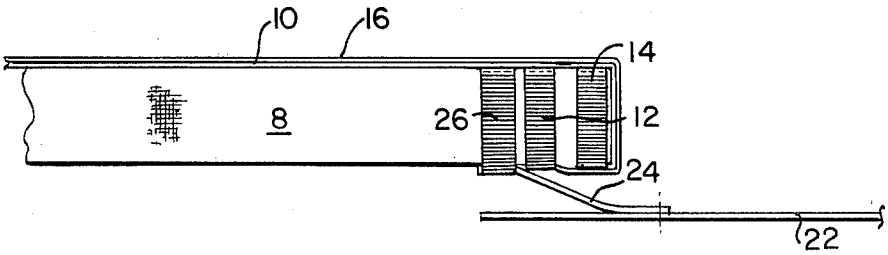

SYSTEM AND METHOD FOR SECURING BED COVERINGS TO THE MATTRESS OF A BED

DESCRIPTION

1. Technical Field

This invention relates to a method and system for securing bed coverings to the mattress of a bed.

2. Background Art

Means have been developed for securing coverings to a mattress for various purposes. U.S. Pat. No. 2,239,017 discloses incorporating elastic bands at each end of a sheet covering a mattress, with additional bed coverings slipped beneath the elastic band. U.S. Pat. No. 3,144,666 discloses placing an elastic strap at the foot end of a bedspread having a plastic lining to prevent sliding of the spread. U.S. Pat. No. 4,045,831 discloses a bed sheet having pockets at each end which are used to enclose the head and foot portions of a mattress when used as a bottom sheet. When used as a top sheet, one pocket is used to enclose the foot end of the mattress and the other pocket to tuck any blankets thereunder. U.S. Pat. No. 3,606,622 discloses a bed sheet having folds along the edges thereof into which weights are placed to hold the sheet taut on the bed.

DISCLOSURE OF INVENTION

It is a principal object of this invention to provide a method and system for securing bed coverings to the mattress of a bed such that they cannot be pulled loose or displaced by occupants sleeping in the bed.

It is a further object of this invention to provide a method and system which allow a bed to be made quicker and easier on a day-by-day basis and to allow the sheets of a bed to be changed quicker and easier.

It is a further object of this invention to provide a method and system for securing bed coverings to a mattress wherein the bedspread includes a flap near the foot end thereof for securement beneath the mattress, the flap including an elastic strap along its terminal edge extending over and across the top surface of the mattress when in place.

These and other objects are achieved by incorporating an elastic strap along one end of the top sheet and any blankets to be used on the bed, the strap secured to the sheet or blankets at spaced points along the width thereof essentially equal to the width of the mattress. The spread includes a flap secured near the foot end thereof extending essentially the width of the mattress and including an elastic strap on its bottom side at the terminal edge thereof adapted to fit around and extend over the top surface of the mattress.

BRIEF DESCRIPTION OF THE DRAWINGS

FIG. 1 is a perspective view of a top sheet, blanket and spread modified to include means for attaching them to the mattress of a bed as described;

FIG. 2 is a side elevational view illustrating the coverings to be secured to the bed mattress;

FIG. 3 is a bottom view of a spread incorporating the modifications described herein; and FIG. 4 is a side elevational view illustrating, in part, the procedure for making the bed.

BEST MODE FOR CARRYING OUT THE INVENTION

FIG. 1 illustrates in perspective a spread, blanket and top sheet modified as described for securing to the mattress of a bed. It should be understood that fewer or more blankets, sheets, or other bed coverings may be used than those described.

Each of the sheets and/or blankets used is fitted with an elastic strap secured at or near the foot end of the covering to be secured to the foot end of the mattress 8. Referring to FIG. 1, sheet 10 includes an elastic strap 12 at one end thereof, the elastic strap extending approximately the width of the mattress 8 and secured to the sheet by sewing, adhesive bonding, or otherwise. An elastic strap 14 is similarly secured to one end of blanket 16, the strap extending approximately the width of the mattress. The sizes of the sheets and/or blankets used are those conventionally used, depending on the size of the bed involved. Sheets and/or blankets generally have a width and length in excess of the width and length of the mattress to allow them to drape over the side of the mattress but not touch the floor. The width of the elastic strap secured to the sheet and blanket is not critical, but generally ranges from three to six inches. If desired, an antifriction material 18 may be secured to the portion of the sheet or blanket on the side opposite the side to which the elastic strap is secured to aid in preventing the covering from being pulled loose from the mattress. Antifriction materials which may be used include corrugated or rippled strips of natural or synthetic rubber or synthetic plastic materials. Additionally, if desired, the sheet and/or blanket may include an antifriction material 20 secured to the surface of the blanket opposite the elastic strap.

The spread 22 includes a flap 24, generally made of the same material as the spread and extending approximately the width of the mattress. The flap is sewn or otherwise secured to the lower surface of the spread parallel to and at a distance from the terminal end or foot end of the spread corresponding to the length of spread that it is desired to have drape over the mattress. The length of the flap is not particularly critical, but is preferably 10 to 20 inches in length. An elastic strap 26 is secured at its respective ends to the side edges of the flap at its free end. If desired, all or part of the upper surface of the flap may include an antifriction material 28 of the same type as described with regard to the sheet and blanket to aid in preventing the spread from being pulled loose from the mattress. Likewise, an antifriction material 30 may be included on the lower surface of the flap opposite the elastic strap, as shown.

If a comforter is used rather than a bedspread, it can be modified in the same manner as the spread. If a spread and comforter are both used, the spread should be modified to include only an elastic strap in the same way as the sheet and/or blanket.

Procedure

The typical bedcovers used include a spread, one or more blankets, and a top sheet. These bed coverings, modified as described above, are secured to the mattress in reverse order to the way a bed is typically made; that is, the spread is first secured to the mattress, then a blanket or blankets, then the top sheet, followed by a mattress pad (if one is used), and the bottom sheet.

The spread is secured to the mattress by securing the flap thereof beneath the mattress, with the elastic strap extending over and across the top surface of the mattress as illustrated in FIG. 4. The spread is not at this time pulled over the top surface of the mattress but is allowed to remain at the foot end thereof. A blanket or blankets are then secured to the mattress by securing the elastic strap across the top surface of the mattress, with the foot end of the blanket extending between the underside of the mattress and the flap of the spread. The blanket is is also not pulled over the top of the mattress at this time. The foot end of the top sheet is then secured between the underside of the mattress and the blanket, with the elastic strap thereof extending across the top surface of the mattress as illustrated. After the top coverings have been secured to the mattress as described above a conventional mattress pad, if one is used, is then secured over the top surface of the mattress and a bottom sheet, fitted or otherwise, secured to the mattress in the ordinary way. The top sheet, blanket and spread are then pulled over the top surface of the mattress to make the bed.

A distinct advantage of the system and method described herein is the ease and time saving involved in making the bed on a day-to-day basis and the saving in changing the sheets of a bed, compared to the conventional way that this is done. To change the sheets of a bed fitted with bed coverings of the type described above, the spread, blankets (if used), and top sheet are pulled back to expose the bottom sheet. The bottom sheet is then removed and the top sheet removed by removing the elastic strap from around the mattress. A clean top sheet and bottom sheet are then replaced once removed and the blankets and spread pulled back over the top surface of the mattress without having to totally remove them.

I claim:

1. A system for securing coverings to the mattress of a bed to prevent their being pulled loose by one sleeping on the bed and make the task of making the bed easier and faster, comprising:

a mattress;

a top sheet for the mattress of greater length and width than the mattress having an elastic strap secured near one end to one surface thereof at two spaced points along the width dimension of the sheet a distance apart essentially equal to the width of the mattress, the strap adapted to fit around and extend over the upper surface of the foot end of the mattress when the end of the sheet having the strap is wrapped around the foot end of the mattress; and a spread to cover the top sheet and mattress of greater length and width than the mattress having a flap with a width essentially equal to the width of the mattress having an elastic strap with its free end secured at spaced points to one end of the flap, the other end of the flap secured along its width dimension to the surface of the spread which is not exposed when the bed is made, the elastic strap adapted to extend around and over the upper surface of the mattress near the foot end thereof when the flap is wrapped around the foot end of the mattress.

2. The system of claim 1, including one or more additional bed coverings, each of greater length and width than the mattress and each having an elastic strap secured at two spaced points to one surface thereof near the end thereof to be secured to the foot end of the mattress, the respective elastic straps adapted to extend over the upper surface of the mattress when in place.

3. The system of claim 2 wherein the surface of the additional bed coverings beneath the elastic strap include an antifriction material.

4. The system of claim 3 wherein the surface of the flap of the spread opposite the elastic strap includes an antifriction material.

5. A method of securing bed coverings to the mattress of a bed to allow easy removal and replacement of the sheets of the bed and to prevent the coverings from being pulled loose from the mattress by one sleeping in the bed, comprising:

providing a spread of greater length and width than the mattress having a flap with a width essentially equal to the width of the mattress secured to the surface of the spread near the foot end thereof which is not exposed when the bed is made, the flap extending parallel to the width dimension of the spread and having an elastic strap secured to its side edges at the free end thereof;

securing the flap of the spread around the foot end of the bed and beneath the mattress with the elastic strap thereof extending around and across the top surface thereof;

providing a top sheet for the mattress of greater length and width than the mattress having an elastic strap with its free ends secured to one surface thereof a distance apart essentially equal to the width of the mattress;

securing the portion of the top sheet with the elastic strap around the foot end of the bed and between the lower surface of the mattress and the flap of the spread, the elastic strap of the sheet extending around and across the top surface of the mattress;

covering the mattress with a bottom sheet; and covering the exposed bottom sheet with the top sheet and spread.

6. The method of claim 5, including providing a blanket for the mattress of greater length and width than the mattress having an elastic strap with its free ends secured to the blanket near one end a distance apart essentially equal to the width of the mattress at or near the terminal edge thereof, and securing the blanket between the underside of the mattress and the flap of the spread prior to securing the top sheet to the mattress, with the strap of the blanket extending over the top surface of the mattress near its foot end.

* * * * *